US005290214A

United States Patent [19]

Chen

[11] Patent Number: 5,290,214

[45] Date of Patent: Mar. 1, 1994

[54] EXERCISER

[76] Inventor: Tsung-Yu Chen, No. 1-9, Ting-Liao, San Ho Tsuen, Shui-Shang Hsiang, Chiayi Hsien, Taiwan

[21] Appl. No.: 54,205

[22] Filed: Apr. 30, 1993

[51] Int. Cl.[5] ..... A63B 21/06

[52] U.S. Cl. ..... 482/137; 482/100; 482/136; 482/138

[58] Field of Search ..... 482/97, 98, 99, 100, 482/101, 102, 103, 133, 135, 136, 137, 138

[56] References Cited

U.S. PATENT DOCUMENTS

| | | | |
|---|---|---|---|
| 3,912,261 | 10/1975 | Lambert, Sr. | 482/136 X |
| 4,390,179 | 6/1983 | Szkalak | 482/138 X |
| 4,505,475 | 3/1985 | Olschansky et al. | 482/138 X |
| 4,757,992 | 7/1988 | Heitsch et al. | 482/136 |
| 4,799,670 | 1/1989 | Williamson | 482/136 X |
| 4,809,972 | 3/1989 | Rasmussen et al. | 432/99 |
| 4,817,943 | 4/1989 | Pipasik | 482/137 X |
| 4,844,456 | 7/1989 | Habing | 482/100 |
| 4,915,379 | 4/1990 | Sapp | 482/138 |
| 4,949,951 | 8/1990 | Deola | 482/138 |
| 4,964,632 | 10/1990 | Rockwell | 482/137 X |
| 4,986,538 | 1/1991 | Ish, III | 482/138 |
| 5,120,289 | 6/1992 | Yu | 482/137 |
| 5,190,509 | 3/1993 | Davison, Jr. | 482/137 X |

FOREIGN PATENT DOCUMENTS

| | | | |
|---|---|---|---|
| 2581550 | 11/1986 | France | 482/137 |

*Primary Examiner*—Robert Bahr

*Attorney, Agent, or Firm*—Longacre & White

[57] ABSTRACT

An exerciser including a generally horizontal top frame having a front end, a column supporting the top frame, a movable frame mounted on the top frame and movable between the front end of the top frame and the column, the movable frame having two spaced vertical hollow frame sections and a cross frame section interconnecting lowermost ends of the vertical hollow frame sections, two push arms connected privotally to the movable frame and capable of being pivoted toward each other, and a stop rod extending frontward from the column below the top frame so as to limit movement of the movable frame toward the column. The exerciser further includes a first locking unit which is operable to prevent movement of the movable frame relative to the top frame and a second locking unit which is operable to prevent movement of the push arms relative to the movable frame.

4 Claims, 9 Drawing Sheets

EXERCISER

BACKGROUND OF THE INVENTION

1. Field of the Invention

This invention relates to an exerciser, more particularly to an improved exerciser of the type having multiple exercise units that include a two-in-one exercise station which si constructed to facilitate a change from one exercise mode to another.

2. Description of the Related Art

Referring to FIG. 1, a conventional universal gym is shown to include a plurality of exercise units, such as a press unit (N), a butterfly unit (O), a leg curl/extension unit (P) and a high pull unit (Q), installed on the main frame (M) of the universal gym. A stack of rectangular weights (R) are slide-mounted on a pair of vertical guide roads (M1) and are connected to each of the exercise units (N,O,P,Q) by means of cables (S) and pulley sets (T). The structure of this kind of conventional universal gym is complicated, and a large space for installing and operating the same is required.

To reduce the aforementioned problems, some improvements are provided. As best illustrated in FIGS. 2 and 3, a conventional multipurpose exerciser has a press unit that incorporates a butterfly unit. The exerciser includes a horizontal top frame (U) which has a front end and which is supported by a column (X). A movable frame includes two spaced vertical frame sections (V) and a cross frame section (V1) that interconnects lowermost ends of the vertical frame sections (V). A bar (U1) interconnects uppermost ends of the vertical frame sections (V) and is mounted on the top frame (U) in such a manner that the movable frame is movable between the front end of the top frame (U) and the column (X). A stop rod (X1) extends frontward from the column (X) below the top frame (U) so as to limit movement of the movable frame toward the column (X). Two push arms (V3) are connected pivotally and respectively to two ends of the cross frame section (V1) by means of a pivot pin (V2). A positioning plate (W) extends upward from the cross frame section (V1) and is located between the vertical frame sections (V) of the movable frame. The positioning plate (W) has a guide slit (W1) that extends from an upper end to a lower end portion thereof. A pivot seat (Y) is secured on the stop rod (X1). A pivot rod (Y1) is threaded externally at one end (Y2) and is mounted pivotally on the pivot seat (Y) at the other end. A nut (Y3) engages threadably the pivot rod (Y1) and is movable axially relative to the pivot rod (Y1). When the pivot rod (Y1) is pivoted and is inserted selectively into the guide slit (W1) of the positioning plate (W), the nut (Y3) is rotated to move toward the pivot seat (Y) along the pivot rod (Y1) so as to abut against the positioning plate (W) in order to prevent the movement of the movable frame relative to the top frame (U). Thus, the exerciser is in a butterfly unit mode, and the push arms (V3) can be pivoted toward each other. When the nut (Y3) is rotated to move away from the pivot seat (Y) along the pivot rod (Y1), the pivot rod (Y1) can be disengaged from the guide slit (W1) in such a manner that the exerciser is in a press unit mode so that the movable frame can be moved between the column (X) and the front end of the top frame (U). The aforementioned improvement still has the following drawbacks:

1. It is inconvenient for a user to operate the pivot rod (Y1) and the nut (Y3) when the exerciser is changed from the press unit mode to the butterfly unit mode, or vice versa.

2. In the press unit mode, relative movement between the cross frame section (V1) and the push arms (V3) occurs when the movable frame is moved from the column (X) to the front end of the top frame (U).

3. Untimely disengagement of the pivot rod (Y1) from the guide slit (W1) in the positioning plate (W) may occur due to improper operation of the nut (Y3).

SUMMARY OF THE INVENTION

Therefore, the main object of this invention is to provide an exerciser that includes a two-in-one exercise station which is constructed to facilitate a change from one exercise mode to another.

According to this invention, an exerciser includes a generally horizontal top frame having a front end, a column supporting the top frame, a movable frame, two push arms, a stop rod, a first locking unit and a second locking unit. The movable frame is mounted on the top frame and is movable between the front end of the top frame and the column. The movable frame has two spaced vertical hollow frame sections and a cross frame section interconnecting lowermost ends of the vertical hollow frame sections. The push arms are connected pivotally to the movable frame and can be pivoted toward each other. The stop rod extends frontward from the column below the top frame so as to limit movement of the movable frame toward the column. The first locking unit includes a curved positioning plate that extends upward from the cross frame section and that is located between the vertical hollow frame sections of the movable frame. The curved positioning plate curves toward the column and has a guide slit extending from an upper end to a lower end thereof and two aligned grooves which are transverse to the guide slit and which are located adjacent to the lower end of the positioning plate. The first locking unit further includes a pivot rod having one end mounted pivotally on the stop rod and two opposed horizontal locating projections extending radially outward therefrom. The locating projections engage respectively the aligned grooves in the positioning plate when the pivot rod is pivoted and inserted selectively into the guide slit to prevent movement of the movable frame relative to the top frame. Each of the vertical hollow frame sections has a longitudinal slot formed therein and a notch which extends from one side of the longitudinal slot and which is spaced from a lowermost end of the slot. The movable frame further has two positioning holes which extend through the lowermost end of a corresponding vertical hollow frame section and the cross frame section. Each of the push arms has a locking hole which is formed therethrough and which is vertically aligned with a corresponding positioning hole. The second locking unit includes two generally L-shaped locking rods. Each of the locking rods has a vertical end portion disposed inside a respective one of the vertical hollow frame sections and a horizontal end portion which extends out of the respective one of the vertical hollow frame sections through the slot. The locking rods are movable selectively along the slots between a first position, wherein the horizontal end portions of the locking rods are disposed adjacent to the lowermost ends of the slots and the vertical end portions of the locking rods extend through the positioning holes and into the locking holes in order to prevent pivoting movement of the push arms relative to the movable frame, and a second position, wherein the horizontal end portions engage the notches and the vertical end portions cease to extend into the locking holes to permit pivoting movement of the push arms relative to the movable frame.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENT

Figure 1:
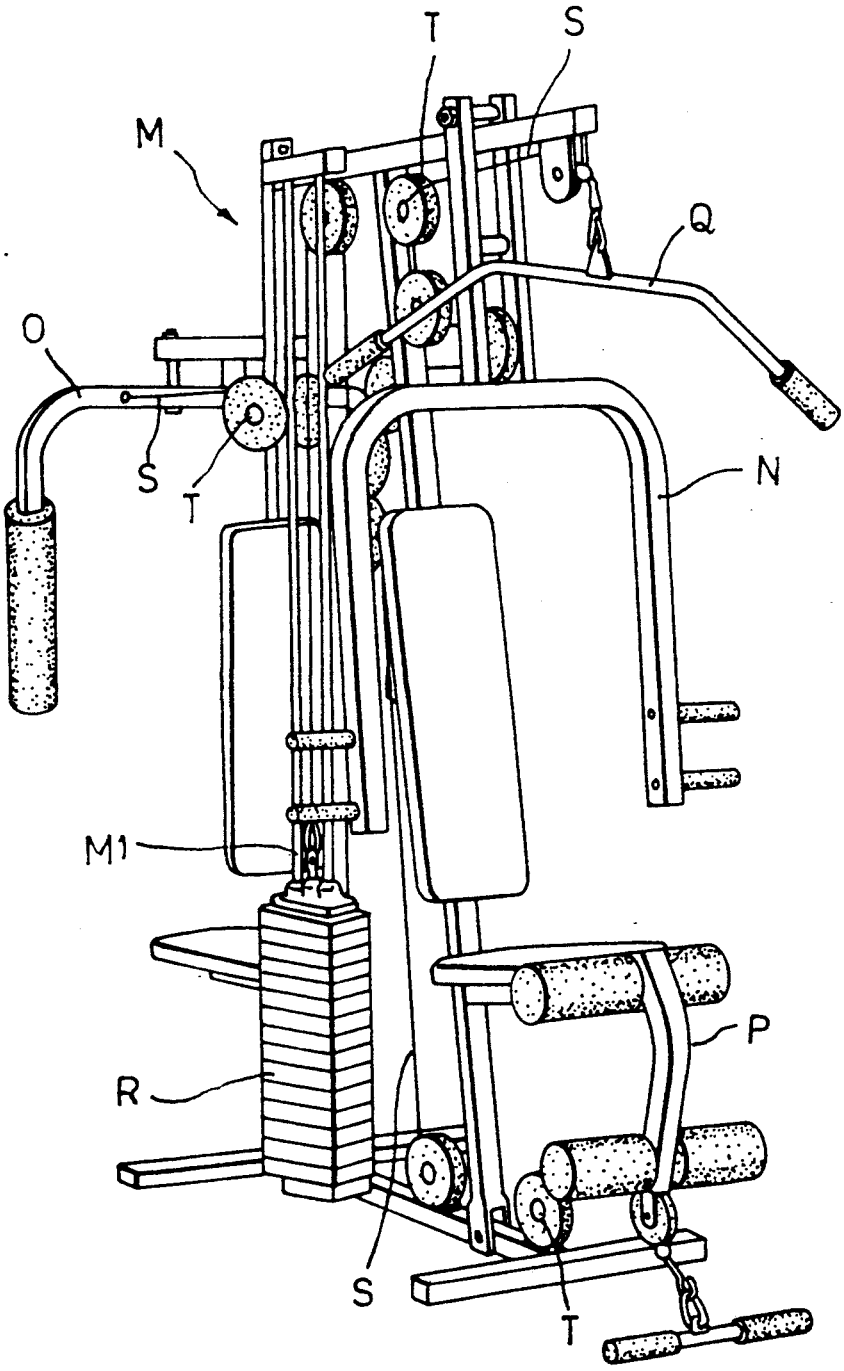
FIG.1 PRIOR ART
FIG. 1 is a perspective view of a conventional universal gym.
Figure 2:
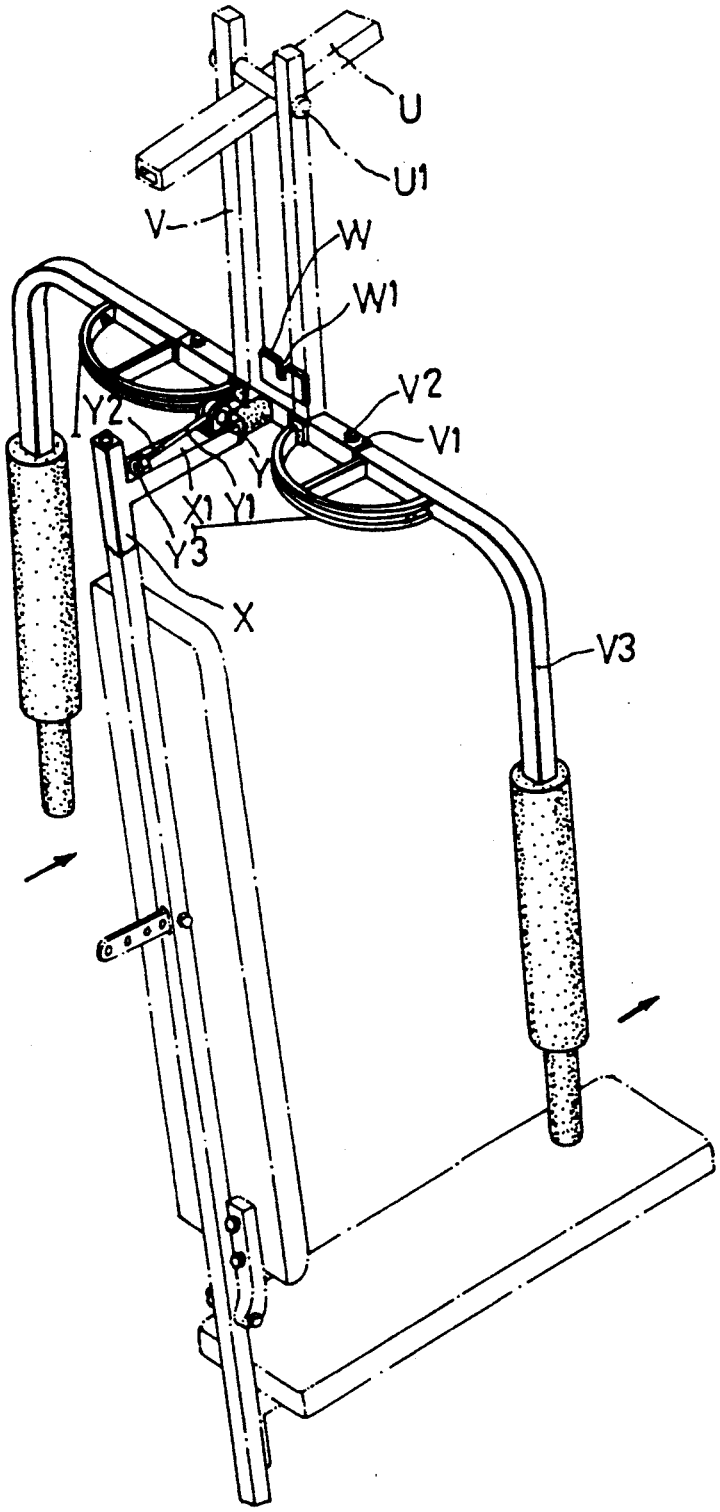
FIG. 2 PRIOR ART
FIG. 2 is a perspective view showing a part of a conventional multipurpose exerciser when the exerciser is in a press unit mode.
Figure 3:
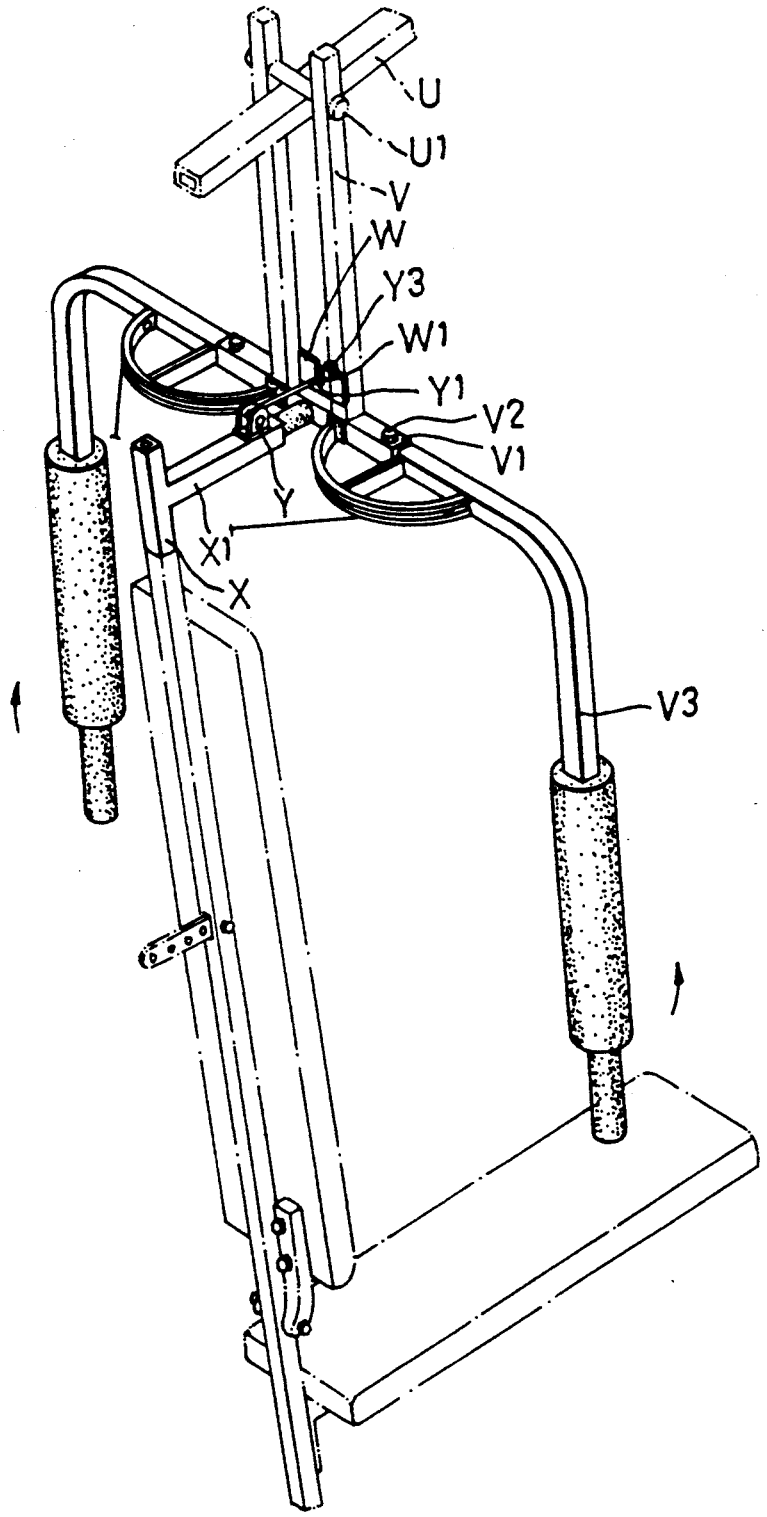
FIG.3 PRIOR ART
FIG. 3 is a perspective view showing a part of a conventional multipurpose exerciser when the exerciser is in a butterfly unit mode.
Figure 4:
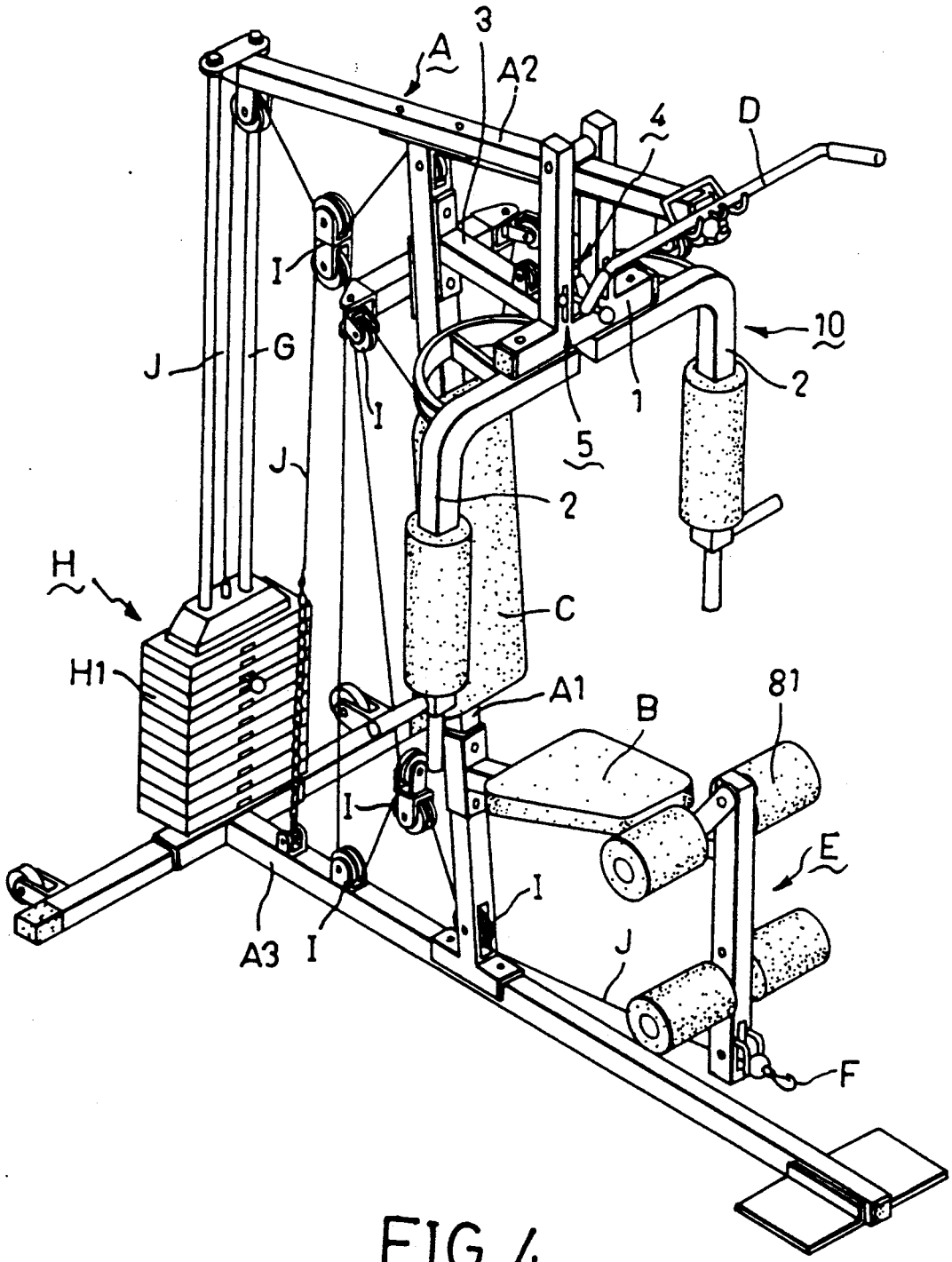
FIG. 4 is a perspective view of an exerciser according to a first embodiment of the present invention.
Figure 5:
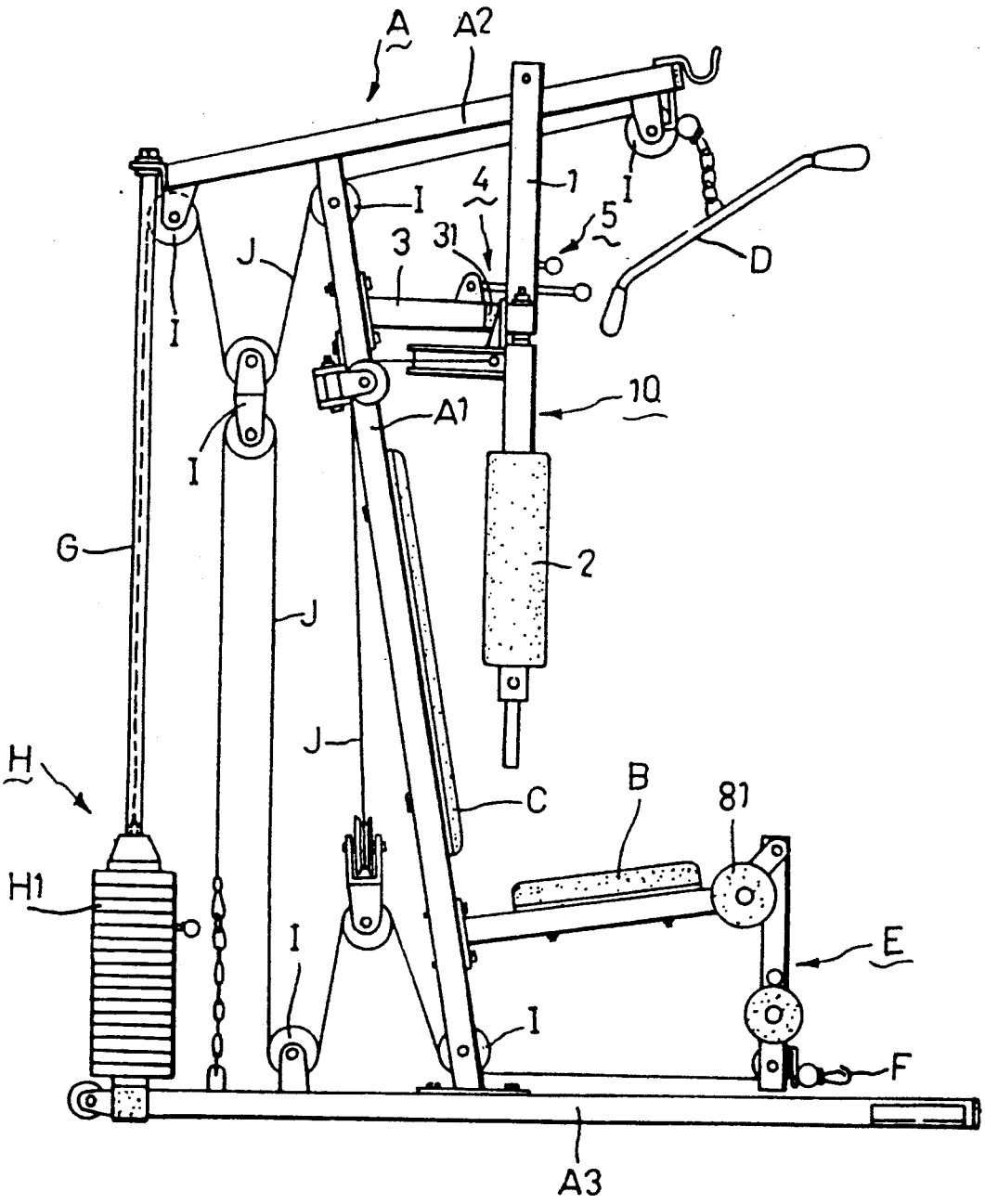
FIG. 5 is a side view of the exerciser according to the first embodiment of the present invention.

Referring to FIGS. 4 and 5, an exerciser according to a first embodiment of this invention includes a main frame assembly (A). The main frame assembly (A) includes a base frame (A3), a generally horizontal top frame (A2) having a front end, and a column (A1) which interconnects the base frame (A3) and the top frame (A2) and which supports the top frame (A2). A backrest cushion (C) and a seat cushion (B) are mounted securely on the column (A1). A two-in-one exercise station (10), which can be operated selectively in a press unit mode and in a butterfly unit mode, is mounted operatively on the top frame (A2). A conventional high pull unit (D) is mounted operatively on the front end of the top frame (A2). A conventional leg curl/extension unit (E) is mounted operatively on the column (A1) in front of the seat cushion (B). A conventional low pull unit (F) is mounted operatively on the column (A1) below the leg curl/extension unit (E). A conventional weight stack unit (H) includes a stack of rectangular weights (H1) which are slide-mounted on a pair of vertical guide rods (G). The exercise station (10) and exercise units (D,E,F) are connected to the weight stack unit (H) by means of cables (J) and pulley sets (I).

Figure 6:
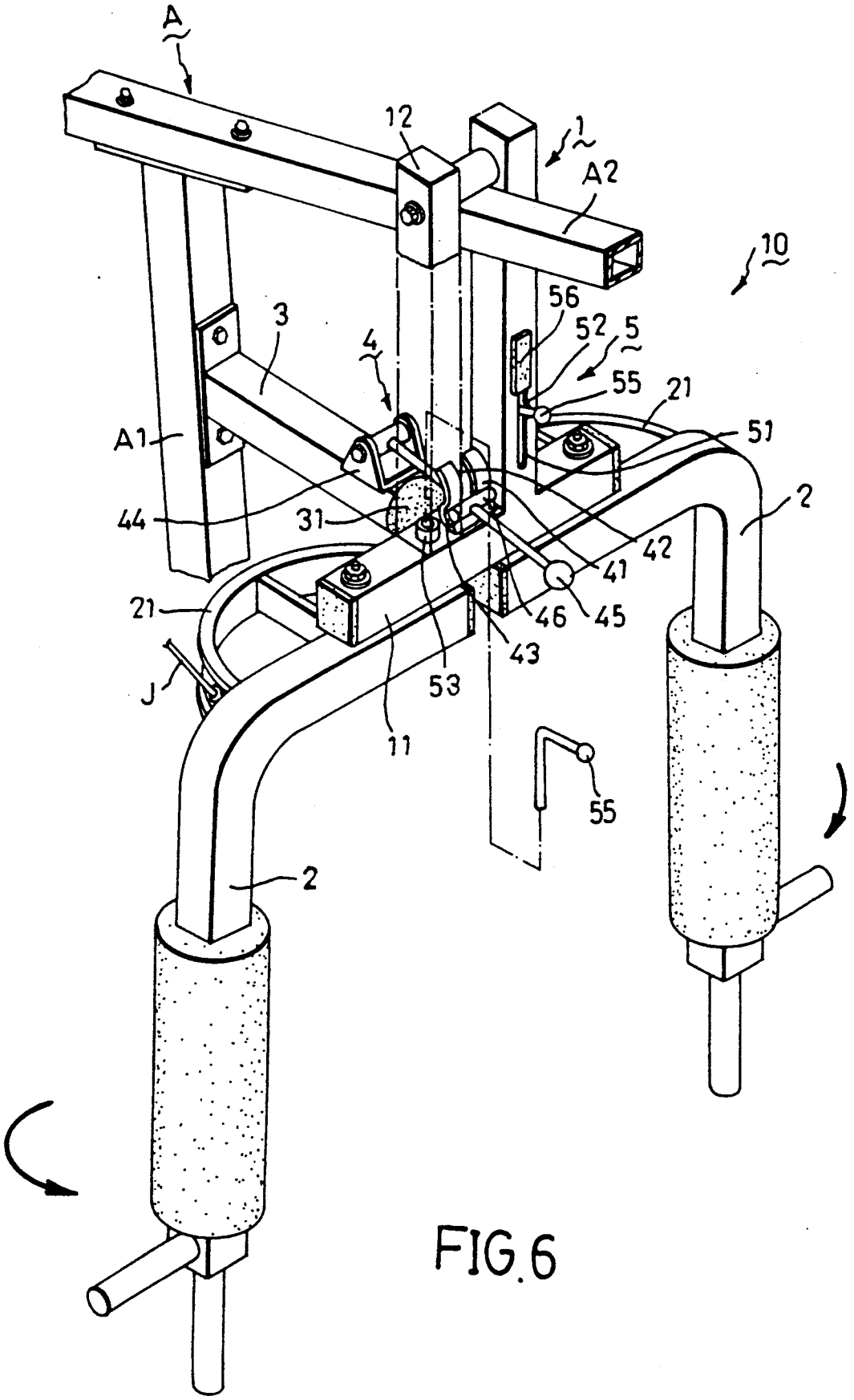
FIG. 6 is a perspective view showing a part of the exerciser according to first embodiment of the present invention when the exerciser is in a butterfly unit mode.
Figure 7:
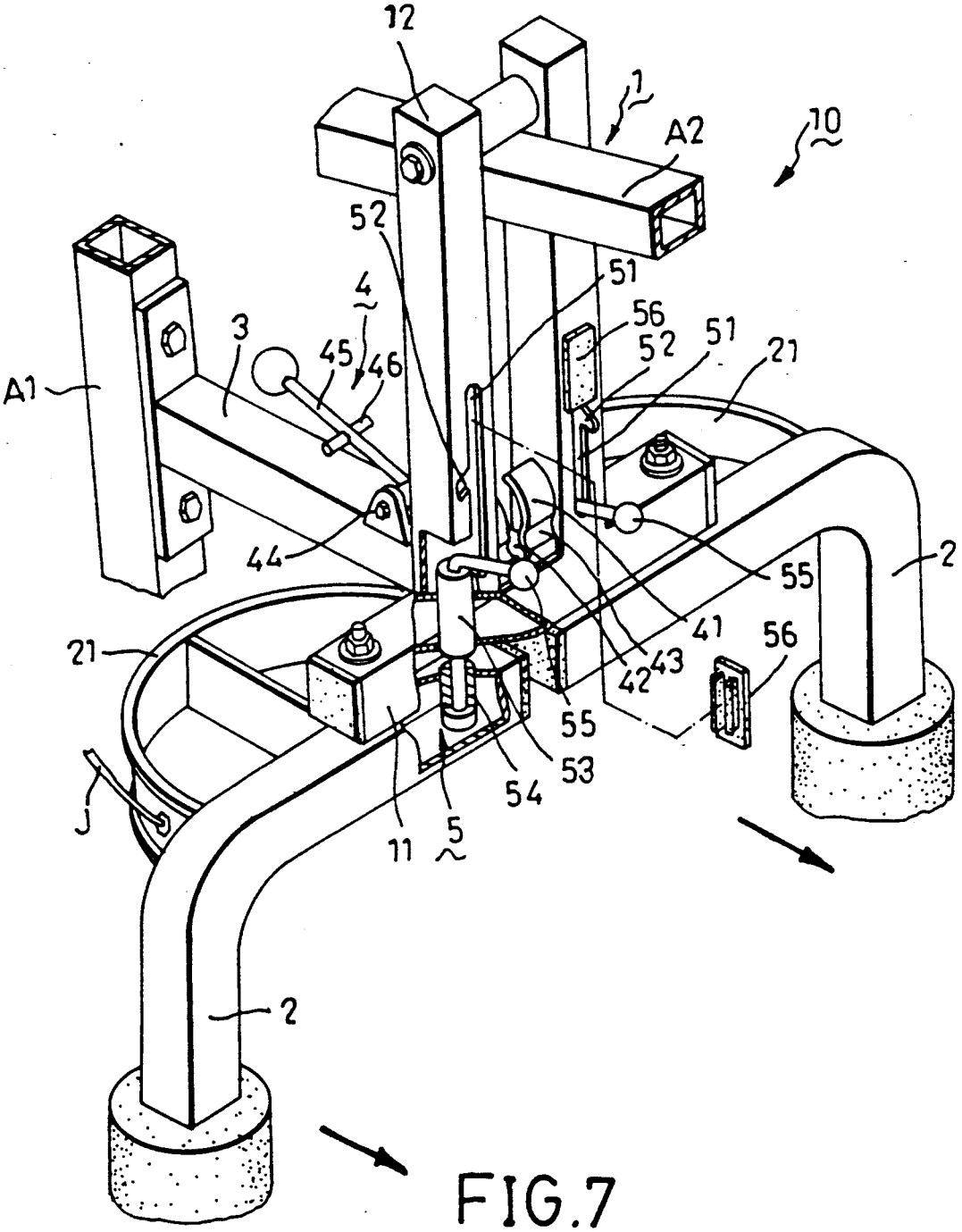
FIG. 7 is a perspective view showing a part of the exerciser according to the first embodiment of the present invention when the exerciser is in a press unit mode.

Referring to FIGS. 6 and 7, the exercise station (10) includes a movable frame (1) which is mounted on the top frame (A2) and which is movable between the front end of the top frame (A2) and the column (A1). The movable frame (1) has two spaced vertical hollow frame sections (12) and a cross frame section (11) that interconnects the lowermost ends of the vertical hollow frame sections (12). Two push arms (2) are connected pivotally to the cross frame section (11) of the movable frame (1) and can be pivoted toward each other. Two semi-circular guide wheels (21) are connected respectively to the rear sides of the push arms (2) and are connected to the weight stack unit (H) by means of cables (J). A stop rod (3) extends frontward from the column (A1) below the top frame (A2) and has a rubber pad (31) (see FIG. 5) connected to the front end thereof. The stop rod (3) limits movement of the movable frame (1) toward the column (A1).

A first locking unit (4) includes a curved positioning plate (41) which extends upward from the cross frame section (11) and which is located between the vertical hollow frame sections (12) of the movable frame (1). The curved positioning plate (41) curves toward the column (A1) and has a guide slit (42) that extends from an upper end to a lower end thereof and two aligned grooves (43) which are transverse to the guide slit (42) and which are located adjacent to the lower end of the positioning plate (41). The first locking unit (4) further includes a pivot seat (44) which is fixed on the stop rod (3) and a pivot rod (45) which has one end connected pivotally to the pivot seat (44) on the stop rod (3) and which has two opposed horizontal locating projections (46) that extend radially outward therefrom. The locating projections (46) engage respectively the aligned grooves (43) in the positioning plate (41) when the pivot rod (45) is pivoted and is inserted selectively into the guide slit (42) to prevent movement of the movable frame (1) relative to the top frame (A2).

Each of the vertical hollow frame sections (12) has a longitudinal slot (51) formed therein and a notch (52) which extends from one side of the longitudinal slot (51) and which is spaced from a lowermost end of the slot (51).

The movable frame (1) further has two positioning holes (not shown) which extend through the lowermost end of a corresponding vertical hollow frame section (12) and the cross frame section (11), and two guide tubes (53) which extend respectively through the positioning holes. Each of the guide tubes (53) is formed with an axial through hole.

Each of the push arms (2) has a locking hole (not shown) which is formed therethrough and which is vertically aligned with a corresponding positioning hole, and two positioning tubes (54) which extend respectively through the locking holes. Each of the positioning tubes (54) is formed with an axial through hole. The axial through holes of the guide tubes (53) are aligned vertically with the axial through hole of the respective positioning tube (54).

A second locking unit includes two generally L-shaped locking rods (55). Each of the locking rods (55) has a vertical end portion that is disposed inside a respective one of the vertical hollow frame sections (12) and a horizontal end portion which extends out of the respective one of the vertical hollow frame sections (12) through the slot (51). Two plug members (56) are provided respectively at the upper end portions of the longitudinal slots (51) so as to prevent disengagement of the locking rods (55) from the movable frame (1). The locking rods (55) are movable selectively along the slots (51) between a first position, wherein the horizontal end portions of the locking rods (55) are disposed adjacent to the lowermost ends of the slots (51) and the vertical end portions of the locking rods (55) extend through the axial through holes of the guide tubes (53) and into the axial through holes of the positioning tubes (54) in order to prevent pivoting movement of the push arms (2) relative to the movable frame (1), and a second position, wherein the horizontal end portions engage the notches (52) and the vertical end portions cease to extend into the positioning tubes (54) to permit pivoting movement of the push arms (2) relative to the movable frame (1).

Accordingly, when the pivot rod (45) is pivoted and is inserted selectively into the guide slit (42), and the locking rods (55) are moved selectively to the second position, the exercise station (10) is operable in the butterfly unit mode. When the pivot rod (45) is pivoted so as to disengage from the guide slit (42) and the locking rods (55) are moved selectively to the first position, the exercise station (10) is operable in the press unit mode.

Figure 8:
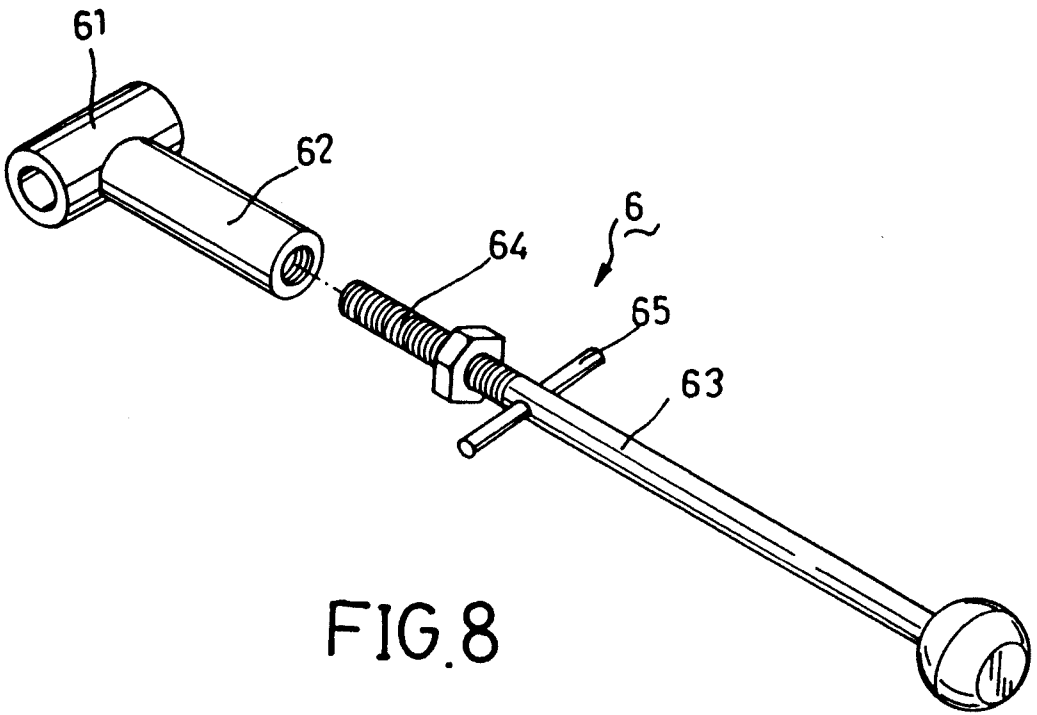
FIG. 8 is an exploded view showing a pivot rod of an exerciser according to a second embodiment of the present invention.

Referring to FIG. 8, a pivot rod (6) of an exerciser according to a second embodiment of the present invention is shown. Unlike the first embodiment, the pivot rod (6) includes a handle rod section (63) from which the two opposed locating projections (65) extend radially outward, and a tubular mounting rod section (62) which is connected pivotally to the pivot seat (not shown) on the stop rod (not shown) at one end (61) and which is threaded internally at the other end. The handle rod section (63) is threaded externally so as to engage threadably the mounting rod section (62) in order to permit axial movement of the handle rod section (63) relative to the mounting rod section (62) to adjust a length of the pivot rod (6). Therefore, the tightness of contact between the stop rod (not shown) and the movable frame (not shown) is adjustable.

Figure 9:
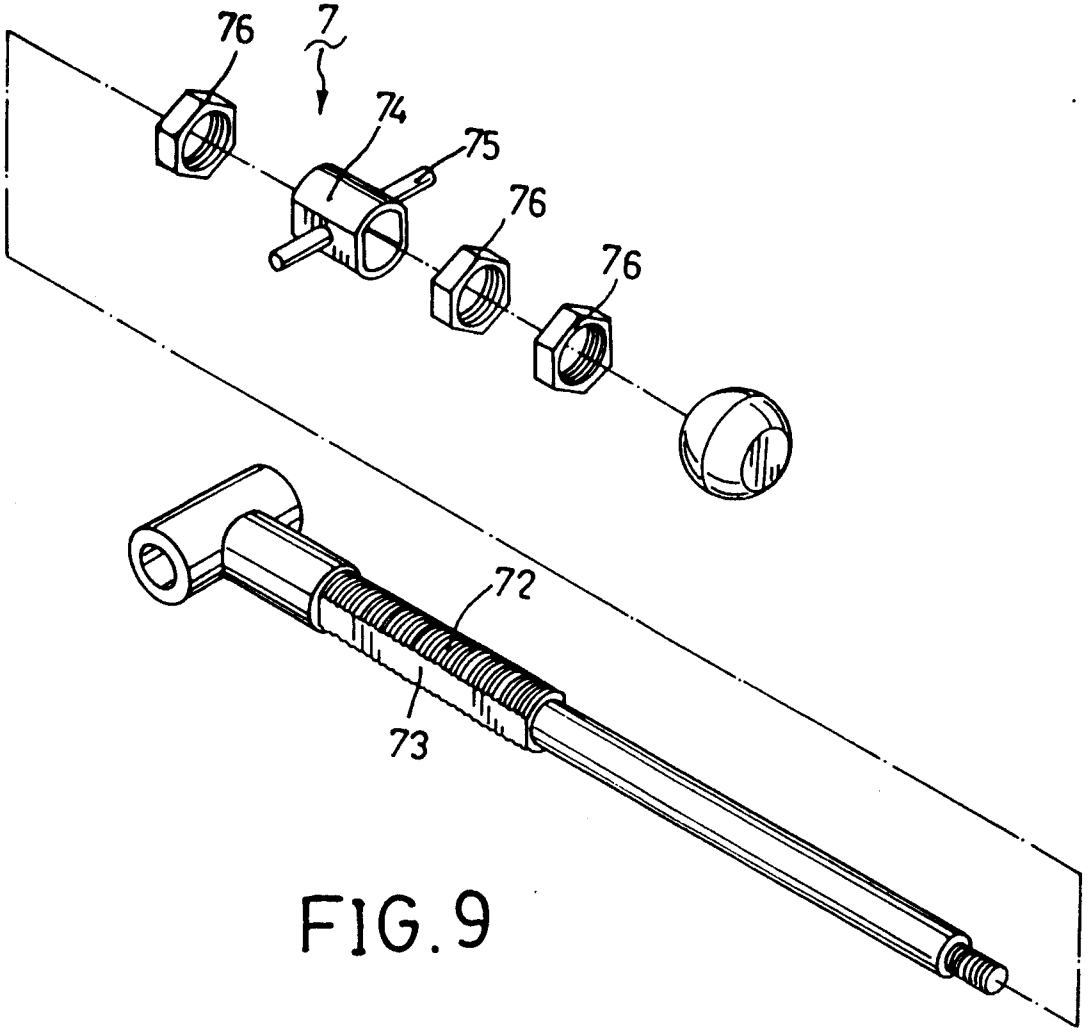
FIG. 9 is an exploded view showing a pivot rod of an exerciser according to a third embodiment of the present invention.

Referring to FIG. 9, a pivot rod (7) of an exerciser according to a third embodiment of the present invention is shown. Unlike the first and second embodiments, the pivot rod (7) includes an externally threaded rod body (72) with two opposed planar surfaces (73), a movable sleeve member (74) from which the two opposed locating projections (75) extend radially outward, the sleeve member (74) is sleeved movably on the rod body (72), and two nuts (76) which engage threadably the rod body (72) and which are disposed on two ends of the sleeve member (74) so that the sleeve member (74) can be positioned at an appropriate position along the rod body (72) in order to adjust the tightness of contact between the stop rod (not shown) and the movable frame (not shown).

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. An exerciser including a generally horizontal top frame having a front end, a column supporting said top frame, a movable frame mounted on said top frame and movable between said front end of said top frame and said column, said movable frame having two spaced vertical hollow frame sections and a cross frame section interconnecting lowermost ends of said vertical hollow frame sections, two push arms connected pivotally to said movable frame and capable of being pivoted toward each other, and a stop rod extending frontward from said column below said top frame so as to limit movement of said movable frame toward said column, wherein the improvement comprises:

a first locking unit including a curved positioning plate that extends upward from said cross frame section and that is located between said vertical hollow frame sections of said movable frame, said curved positioning plate curving toward said column and having a guide slit extending from an upper end to a lower end thereof and two aligned grooves which are transverse to said guide slit and which are located adjacent to said lower end of said positioning plate, said first locking unit further including a pivot rod having one end mounted pivotally on said stop rod and two opposed horizontal locating projections extending radially outward therefrom, said locating projections engaging respectively said aligned grooves in said positioning plate when said pivot rod is pivoted and inserted selectively into said guide slit to prevent movement of said movable frame relative to said top frame;

each of said vertical hollow frame sections having a longitudinal slot formed therein and a notch extending from one side of said longitudinal slot and being spaced from a lowermost end of said slot;

said movable frame further having two positioning holes which extend through said lowermost end of a corresponding said vertical hollow frame section and said cross frame section;

each of said push arms having a locking hole which is formed therethrough and which is vertically aligned with a corresponding said positioning hole;

a second locking unit including two generally L-shaped locking rods, each of said locking rods having a vertical end portion disposed inside a respective one of said vertical hollow frame sections and a horizontal end portion which extends out of said respective one of said vertical hollow frame sections through said slot, said locking rods being movable selectively along said slots between a first position, wherein said horizontal end portions of said locking rods are disposed adjacent to said lowermost ends of said slots and said vertical end portions of said locking rods extend through said positioning holes and into said locking holes in order to prevent pivoting movement of said push arms relative to said movable frame, and a second position, wherein said horizontal end portions engage said notches and said vertical end portions cease to extend into said locking holes to permit pivoting movement of said push arms relative to said movable frame.

2. An exerciser as claimed in claim 1, wherein said movable frame has plug members provided respectively at upper end portions of said longitudinal slots so as to prevent untimely disengagement of said locking rods from said movable frame.

3. An exerciser as claimed in claim 1, wherein said pivot rod includes a tubular mounting rod section which is mounted pivotally on said stop rod at one end and which is threaded internally at the other end, and a handle rod section from which said two opposed locating projections extend radially outward, said handle rod section being threaded externally so as to engage threadably said mounting rod section in order to permit axial movement of said handle rod section relative to said mounting rod section to adjust a length of said pivot rod.

4. An exerciser as claimed in claim 1, wherein said pivot rod includes an externally threaded rod body with two opposed planar surfaces, a movable sleeve member from which said two opposed locating projections extend radially outward, said sleeve member being sleeved movably on said rod body, and two nuts which engage threadably said rod body and which are disposed on two ends of said sleeve member.

* * * * *